US010519668B1

(12) United States Patent
Bachman

(10) Patent No.: US 10,519,668 B1
(45) Date of Patent: Dec. 31, 2019

(54) APPARATUS FOR PREVENTION OF PESTS AND DEBRIS FROM GUTTERS

(71) Applicant: Eric J. Bachman, Omaha, NE (US)

(72) Inventor: Eric J. Bachman, Omaha, NE (US)

( * ) Notice: Subject to any disclaimer, the term of this patent is extended or adjusted under 35 U.S.C. 154(b) by 0 days.

(21) Appl. No.: 15/838,102

(22) Filed: Dec. 11, 2017

Related U.S. Application Data

(63) Continuation-in-part of application No. 15/584,698, filed on May 2, 2017, now abandoned.

(60) Provisional application No. 62/330,821, filed on May 2, 2016.

(51) Int. Cl.
*E04D 13/076* (2006.01)

(52) U.S. Cl.
CPC ..... *E04D 13/076* (2013.01)

(58) Field of Classification Search
CPC ..... E04D 13/076
USPC ..... 52/12
See application file for complete search history.

(56) References Cited

U.S. PATENT DOCUMENTS 4,418,504 A * 12/1983 Lassiter ..... E04D 13/076 210/474
8,322,082 B2 * 12/2012 Neumann ..... E04D 13/076 248/48.1
8,646,218 B1 * 2/2014 Iannelli ..... E04D 13/076 210/162
9,163,406 B1 * 10/2015 Ealer, Sr. ..... E04D 13/076
2005/0097826 A1 * 5/2005 Fox ..... E04D 13/076 52/12
2006/0196124 A1 * 9/2006 Bachman ..... E04D 13/076 52/12
2007/0199249 A1 * 8/2007 Beck ..... E04D 13/076 52/12
2009/0056234 A1 * 3/2009 Brochu ..... E04D 13/076 52/12
2015/0020462 A1 * 1/2015 Iannelli ..... E04D 13/064 52/12
2015/0184392 A1 * 7/2015 Steinberg ..... E04D 13/076 52/12
2015/0330085 A1 * 11/2015 Iannelli ..... E04D 13/064 52/12
2016/0201329 A1 * 7/2016 Ianelli ..... E04D 13/076 52/12
2017/0089070 A1 * 3/2017 Lowrie, III ..... E04D 13/076

* cited by examiner

FOREIGN PATENT DOCUMENTS

GB 2084210 A * 4/1982 ..... E04D 13/076

*Primary Examiner* — Babajide A Demuren
(74) *Attorney, Agent, or Firm* — Suiter Swantz pc llo

(57) ABSTRACT

The present disclosure is an apparatus for prevention of pests and debris from gutters. The apparatus for prevention of pests and debris from gutters may include a cover for protecting a gutter. The cover may include a plurality of apertures aligned to capture the water flowing from the roof of a structure. It is contemplated that a first portion of the cover may include apertures of a first size while a second portion of the cover may include apertures of a second size, where the second size is greater than the first size. Additionally, apparatus for prevention of pests and debris for gutters may include a fascia plate to protect the fascia gap between the roof of a structure and the gutter. The fascia plate may include pre-made slots to allow ventilation and improve installation by providing cutouts to allow quick adjustment in the vertical height of the fascia plate while being installed.

13 Claims, 8 Drawing Sheets

APPARATUS FOR PREVENTION OF PESTS AND DEBRIS FROM GUTTERS

CROSS REFERENCE TO RELATED APPLICATIONS

The present application is a Continuation and claims the benefit under 35 U.S.C. 120 of pending of United States Application entitled APPARATUS FOR PREVENTION OF PESTS AND DEBRIS FROM GUTTERS, naming Eric J. Bachman as inventor, filed May 2, 2017, Application Ser. No. 15/584,698, which is incorporated herein by reference in the entirety. Application Ser. No. 15/584,698 in turn claims benefit under 35 U.S.C. § 119(e) of United States Provisional Patent Application entitled APPARATUS FOR PREVENTION OF PESTS AND DEBRIS FROM GUTTERS, naming Eric J. Bachman as inventor, filed May 2, 2016, Application Ser. No. 62/330,821, which is incorporated herein by reference in the entirety.

TECHNICAL FIELD

The present disclosure generally relates to the field of gutters, and more particularly to an apparatus for prevention of pests and debris from gutters.

BACKGROUND

Gutters are widely employed in commercial and residential structures to capture water, particularly from rain, that falls from a roof of the commercial and residential structures. The capture of rainwater may protect a foundation of the commercial and residential structures by channeling water away from the foundation of a structure and may further prevent undesired erosion. A problem associated with conventional gutters is that debris may collect in the gutters rendering the gutters inoperable to collect excess water from the roof. Also, gutters may attract pests and rodents, particularly when they contain debris.

SUMMARY

The present disclosure is directed to an apparatus for prevention of pests and debris from gutters. The apparatus for prevention of pests and debris from gutters may include a cover for protecting a gutter. The cover may include a plurality of apertures aligned to capture the water flowing from the roof of a structure. It is contemplated that a first portion of the cover may include apertures of a first size while a second portion of the cover may include apertures of a second size, where the second size is greater than the first size. Additionally, apparatus for prevention of pests and debris for gutters may include a fascia plate to protect the fascia gap between the roof of a structure and the gutter. The fascia plate may include pre-made slots to allow ventilation and improve installation by providing cutouts to allow quick adjustment in the vertical height of the fascia plate while also allowing quick adjustment for any horizontal irregularities of the roofline during installation of the fascia plate.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

Referring to FIGS. 1-11, an apparatus for prevention of debris and pests from a gutter in accordance with embodiments of the present disclosure are shown. It is contemplated that the process by which the apparatus prevents debris and pests from a gutter may be a filtration system. It is additionally contemplated that the apparatus for prevention of debris and pests from a gutter may only include a single layer of material be used for drainage whereby conventional products may include multiple layers including a screen and a base layer. It is contemplated that a gutter may refer to a rain catching device and may be also known as an eavestrough, eaves channel, dripster, and guttering.

Referring to FIGS. 1-5, a drop in gutter cover, which may primarily be a direct drainage product, for prevention of debris and pests from a gutter in accordance with embodiments of the present disclosure are shown. In one embodiment, the drop in gutter cover attaches to the front lip of the gutter. In another embodiment, the drop in gutter cover is installed to at least one of the back edge of the gutter, the fascia, the drip edge, the flashing, or under a first row of shingles. In another embodiment, the drop in gutter cover is installed without lowering the gutter on all applications. In another embodiment, the draining ability of the drop in gutter cover comes from numerous small perforations punched through a solid piece of a material. In another embodiment, the drop in gutter cover is installed level with the top lip of the front gutter. In another embodiment, the drop in gutter cover is installed below the top lip of the front of the gutter. In another embodiment, the plane of the drop in gutter includes more material than void.

Figure 1:
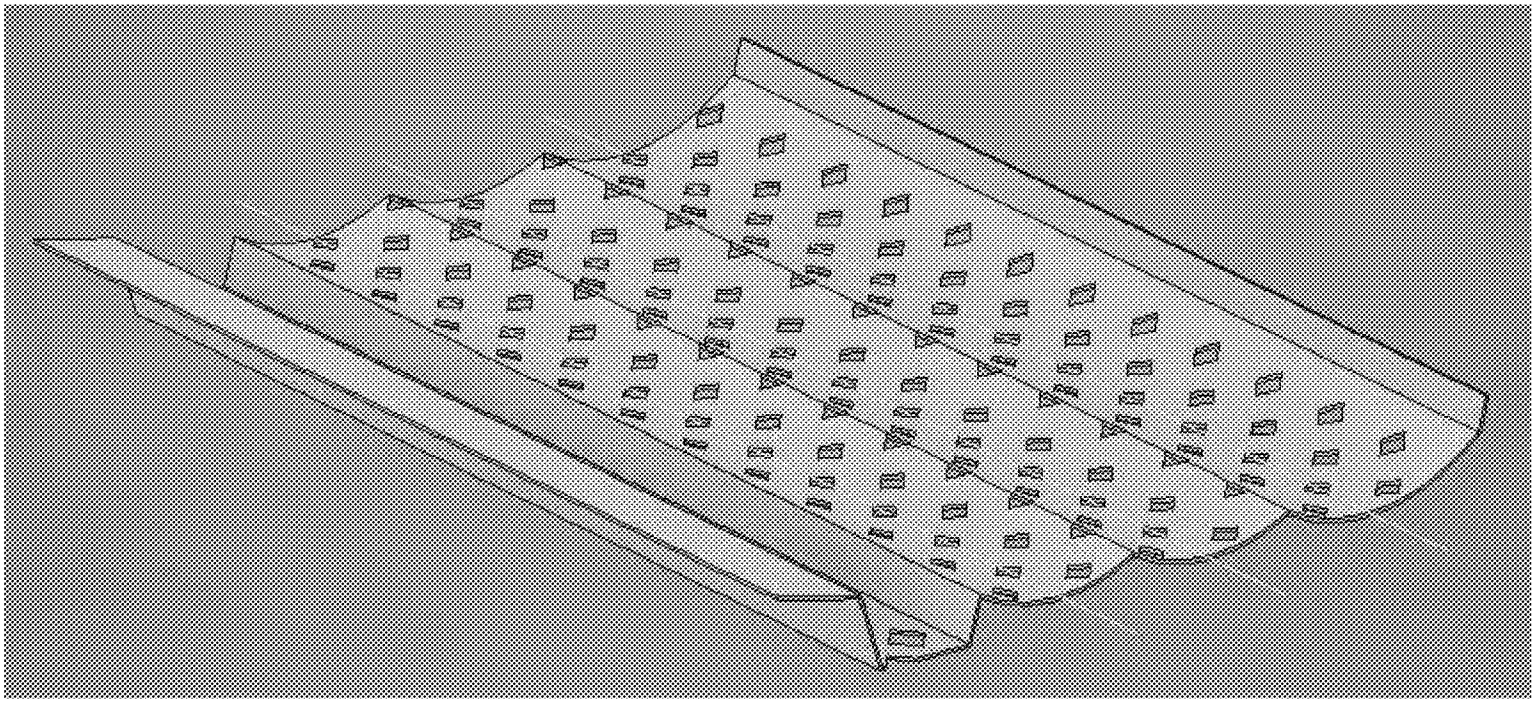
FIG. 1 depicts a perspective view of a drop in gutter cover for protecting a gutter in accordance with an embodiment of the present disclosure.

Referring to FIG. 1, a perspective view of a drop in gutter cover for protecting a gutter in accordance with an embodiment of the present disclosure is shown. It is contemplated that a first portion of the drop in gutter cover may include apertures of a first size while a second portion of the drop in gutter cover may include apertures of a second size, where the second size is greater than the first size. The drop in gutter cover may include a plurality of apertures of a first size, arranged in a way where water droplets traveling a straight line may cross at least one of the apertures.

In one embodiment, apertures of a first size including a diamond-shaped aperture are aligned such that a side of each diamond-shaped aperture forms an oblique angle with the fascia of the roof. For example, all the apertures of a first size may include a diamond-shaped aperture including at least one side of the diamond-shaped aperture forming an oblique angle with the fascia of the roof.

In one embodiment, there are a range of 11 to 15 rows of apertures of a first size in the drop in gutter along a direction orthogonal to the direction of the fascia of the roof. For example, there may be 13 rows of apertures of a first size in the drop in gutter along a direction orthogonal to the direction of the fascia of the roof. In one embodiment, a centroid location of the apertures of the first size are spaced in a range of ⅜ to ⅝ inch. For example, the centroid location of the apertures of a first size may be spaced ½ inch along the length of the drop in gutter cover that runs in a direction parallel to the fascia of the roof.

In one embodiment, the size of the apertures of a first size is in a range of 1/16 to 3/16 inch wide. For example, the size of the apertures of the first size may be ⅛ inch wide. In another embodiment, the apertures of a first size are diamond-shaped. It is contemplated that the oblique angle formed by at least one side of the diamond-shaped apertures of the apertures of the first size with the fascia of the roof may be the same angle.

In one embodiment, there are a range 1 to 4 rows of apertures of a second size in the drop in gutter along a direction orthogonal to the direction of the fascia of the roof. For example, there may be 2 rows of apertures of a second size in the drop in gutter along a direction orthogonal to the direction of the fascia of the roof. In another embodiment, a centroid location of the apertures of the second size are spaced in a range of ⅜ to ⅝ inch. For example, the centroid location of the apertures of a second size may be spaced ½ inch along the length of the drop in gutter cover that runs in a direction parallel to the edge of the roof.

In one embodiment, the size of the apertures of a second size is in a range of ⅛ to ¼ inch wide. For example, the size of the apertures of the second size may be 3/16 inch wide. In another embodiment, the apertures of the second size are diamond-shaped. It is contemplated that the oblique angle formed by at least one side of the diamond-shaped apertures of the apertures of the second size with the fascia of the roof may be the same angle. It is further contemplated that the larger size of the apertures of the second size will allow roof shingle granule(s) to pass through the apertures of the second size while the smaller size of the apertures of the first size will prevent roof shingle granule(s) from passing through the apertures of the first size.

While the apertures are shown as diamond-shaped, they may be circular, triangular, square and various other shaped. The apertures of the first size may prevent debris from entering the gutter. The apertures of the first size may also prevent leaves (e.g. deciduous tree leaves and coniferous tree needles), fruits (e.g. nuts, berries, and samaras) and seeds from entering the gutter. It is contemplated that the apertures of the second size may be about 3/16 inch wide. The larger sized apertures may be suitable for allowing more water to pass through along with allowing roof shingle granule(s) to pass.

Figure 2:
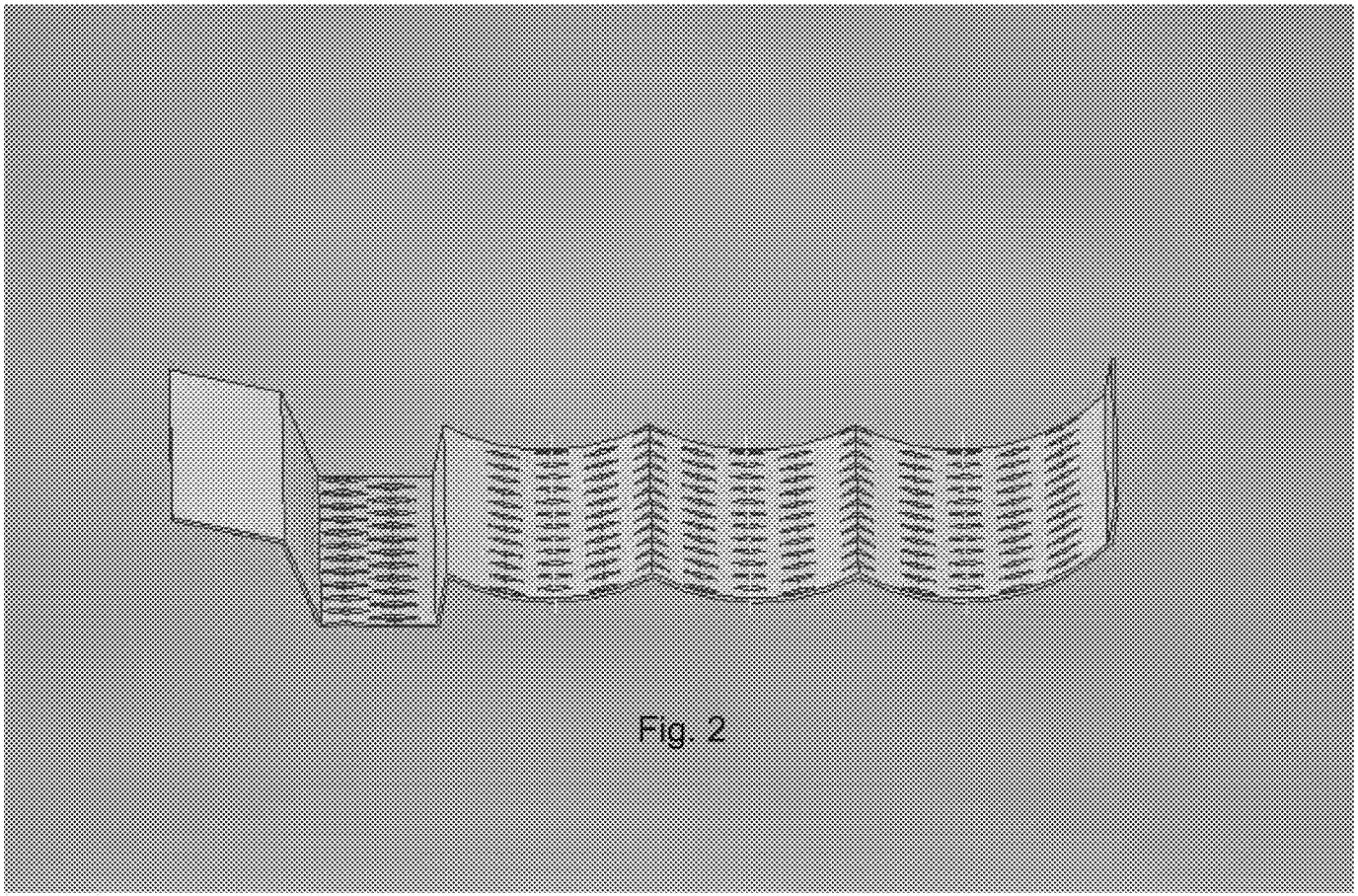
FIG. 2 depicts a side view of a drop in gutter cover for protecting a gutter in accordance with an embodiment of the present disclosure.

Referring to FIG. 2, a side view of a drop in gutter cover for protecting a gutter in accordance with an embodiment of the present disclosure. As shown the drop in gutter cover is installed at an angle, such as 10 to 30 degrees from the rear of the gutter closest to the structure to the lip of the gutter. This may be advantageous as allowing water to pass over the apertures of the first size while preventing roof shingle granule(s) from accumulating and clogging the apertures of the first size. It is further contemplated that an angle of 10 to 30 degrees may reduce or limit the ability of debris to accumulate on the surface of the drop in gutter. In a preferred embodiment, the angle of the drop in gutter cover may be 15 to 20 degrees. It is contemplated that the angle of the drop in gutter cover may allow water to flow away from the house at a speed that permits effective passage of water though the apertures of the cover. Additionally, the first portion of the drop in gutter cover may include a substantially flat surface or may include a corrugated, curved, or wave-like, surface. It is contemplated that a non-flat surface of a drop in gutter cover may slow the flow of water and allow an increased amount of water to pass through the apertures of the first size when compared to a flat surface of a drop in gutter cover or a flat surface of a traditional gutter cover. For example, water flowing down a corrugated surface may slow each time the water encounters resistance to flow as the water moves to a ridge of the corrugated surface.

In one embodiment, the drop in gutter cover includes a plurality of flat portions along a direction parallel to the fascia of the roof that form the corrugated surface of the first portion of the drop in gutter cover. For example, a flat portion along a direction parallel to the fascia of the roof may connect all the apertures of the first size at a same apex of the corrugated surface. By way of another example, a flat portion along a direction parallel to the fascia of the roof may connect apertures of the first size in a same valley of the corrugated surface. By way of yet another example, a flat portion along a direction parallel to the fascia of the roof may connect apertures of the first size that are on a same ascending or descending slope of the corrugated surface. It is contemplated that the apertures of the first size that are connected by a flat portion of the corrugated surface along a direction parallel to the fascia of the roof at an apex or valley of the corrugated surface may allow a greater volume of water to pass through the apertures of a first size than apertures of a first size connected on a same ascending or descending slope of the corrugated surface along a direction parallel to the fascia of the roof.

As further shown in FIG. 2, the second portion of the drop in gutter cover may include a channel where the apertures of the second size may be located. This may further improve capture of water. It is contemplated that the channel may cause the water to churn in the channel and aid in roof shingle granule(s) passing through the apertures of the second size. For example, water as a sheet may flow in the channel in a circular motion moving roof shingle granule(s) over the apertures of the second size until the roof shingle granule(s) pass through the apertures of the second size. It is contemplated that passage of roof shingle granule(s) through the apertures of the second size may enhance water drainage through the apertures of the second size. For example, it is contemplated that should roof shingle granule(s) obstruct the apertures of the second size water drainage would be impeded. It is therefore contemplated that when apertures of the second size are not obstructed the apertures can pass water at a greater velocity due to water filling the channel. For example, as water fills the channel the potential energy related to the depth of the water will force water through the apertures of a second size with greater velocity than if the water had not pooled in the channel. It is further contemplated that the velocity of water passing through the apertures of a second size, due to water pooling in the channel of the second portion of the drop in gutter, is greater than the velocity that would be possible through the apertures of the first size that does not have a channel of similar dimensions as the channel in the second portion of the drop in gutter.

In one embodiment, the channel in the second portion has a depth in the range of 3/16 to 7/16 inch. For example, the depth of the channel in the second portion of the drop in gutter cover may be chosen from one of the depths of 1/4 inch, 3/8 inch or 5/8 inch. In one embodiment, the first portion of the drop in gutter cover includes 2 ridges. For example, the direction of the surface of the first portion of the drop in gutter cover may change direction at least 4 times such that there are 2 ridges in the first portion of the drop in gutter cover. It is contemplated that more or less than 2 ridges may be included in the first portion of the drop in gutter cover.

It is contemplated that the drop in gutter cover may be installed with fasteners applied to a front ridge of the gutter and where connecting to the fascia board of a roof. It is contemplated that the fasteners used to install the drop in gutter cover may be one or more of a screw, a nail, a pin, a stake, or any other fastener that may securely hold the drop in gutter cover in place to the fascia board and the front ridge of the gutter.

In one embodiment, the drop in gutter cover is formed of various rigid, lightweight material such as a metal, an alloy, a plastic or a composite. For example, the drop in gutter cover may be formed from at least one of an aluminum, a metallic composite, a polymer, a polymer composite, a polyvinyl chloride, or a fiberglass. In another embodiment, the drop in gutter cover is formed from a sheet of steel coated in an alloy. For example, the drop in gutter cover may be formed from steel that is hot-dip coated in a zinc-aluminum-magnesium alloy.

Figure 3:
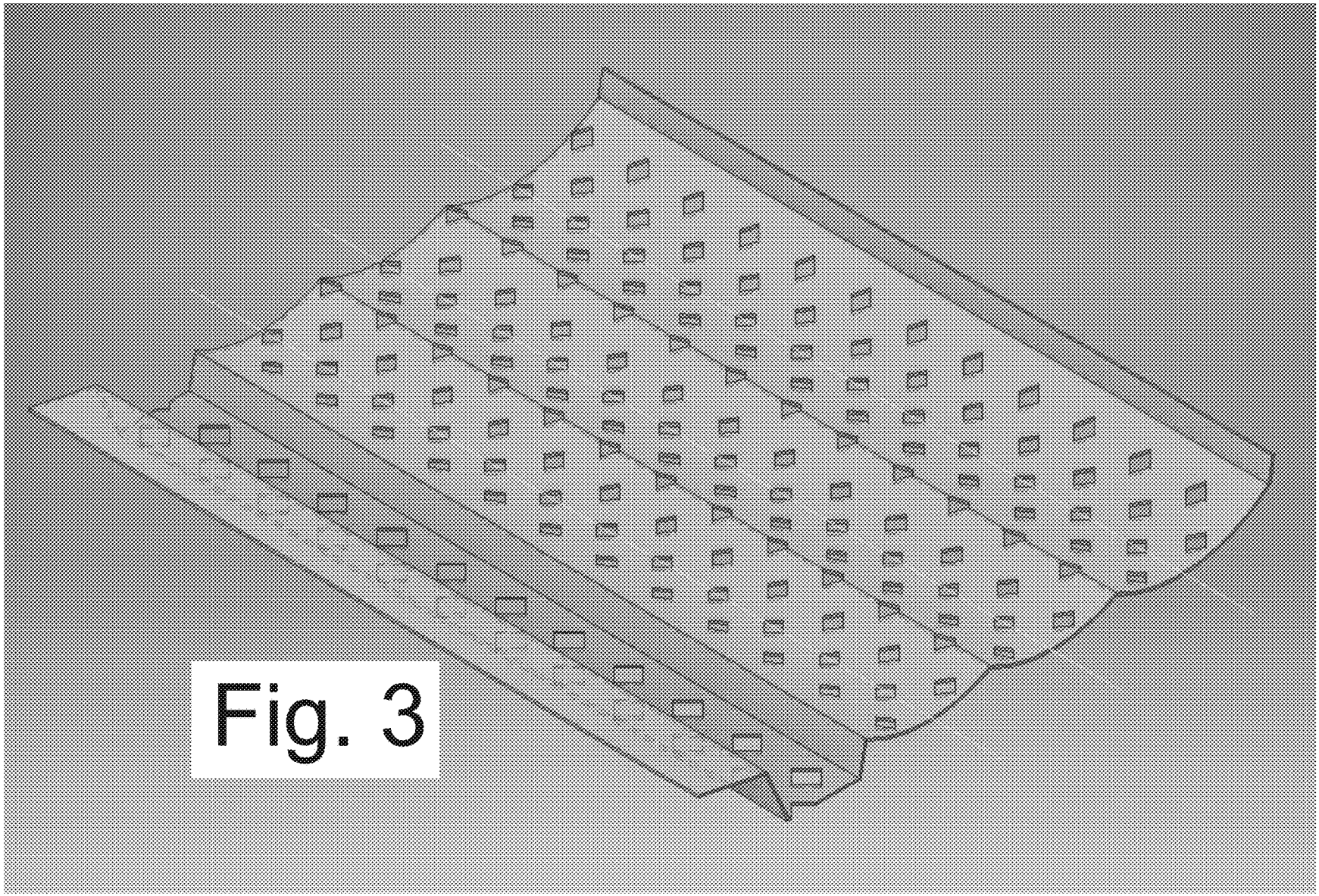
FIG. 3 depicts a perspective view of a drop in gutter cover for protecting a gutter in accordance with an embodiment of the present disclosure.

Referring to FIG. 3, a portion of a drop in gutter cover for protecting a gutter in accordance with an embodiment of the present disclosure. In one embodiment, the drop in gutter cover includes a plurality of valley portions and a plurality of peak portions along a direction parallel to the fascia of the roof that form the corrugated portion of the drop in gutter cover. For example, a plurality of valley portions along a direction parallel to the fascia of the roof may connect at a ridge or peak portions that connects a row of apertures of the first size at a same apex of the corrugated surface. In one embodiment, two ridges may be formed in the first portion of the drop in gutter to connect apertures of the first size at a same peak of the corrugated surface along a direction parallel to the fascia of the roof. It is contemplated that the apertures of the first size that are located in the plurality of valleys in the first portion of the drop in gutter may pass more water than apertures of the first size that are located on a flat surface. Additionally, the apertures may be placed along the lines whereby the widest portion of the apertures are located co-linearly with the lines of the valleys and ridges, which improves drainage.

Figure 4:
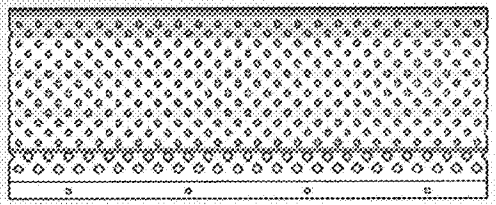
FIG. 4 depicts a portion of a drop in gutter cover for protecting a gutter in accordance with an embodiment of the present disclosure.

Referring to FIG. 4, a portion of a drop in gutter cover for protecting a gutter in accordance with an embodiment of the present disclosure is shown. As shown, the layout of the apertures is arranged to capture water along any path it should take from the roof. In one embodiment, a centroid location of the apertures of the first size are spaced in a range of 3/8 to 5/8 inch. For example, a centroid location of the apertures of a first size may be spaced 1/2 inch along the length of the drop in gutter cover that runs in a direction parallel to the fascia of the roof. In another embodiment, a centroid location of the apertures of the second size are spaced in a range of 3/8 to 5/8 inch. For example, the centroid location of the apertures of a first size may be spaced 1/2 inch along the length of the drop in gutter cover that runs in a direction parallel to the edge of the roof.

In one embodiment, the size of the apertures of a first size is in a range of 1/16 to 3/16 inch wide. For example, the size of the apertures of the first size may be 1/8 inch wide. In another embodiment, the apertures of a first size are diamond-shaped. It is contemplated that the oblique angle formed by at least one side of the diamond-shaped apertures of the apertures of the first size with the fascia of the roof may be the same angle.

In one embodiment, the size of the apertures of a second size is in a range of 1/8 to 1/4 inch wide. For example, the size of the apertures of the second size may be 3/16 inch wide. In another embodiment, the apertures of the second size are diamond-shaped. It is contemplated that the oblique angle formed by at least one side of the diamond-shaped apertures of the apertures of the second size with the fascia of the roof may be the same angle. It is further contemplated that the larger size of the apertures of the second size will allow roof shingle granule(s) to pass through the apertures of the second size while the smaller size of the apertures of the first size will prevent roof shingle granule(s) from passing through the apertures of the first size.

Figure 5:
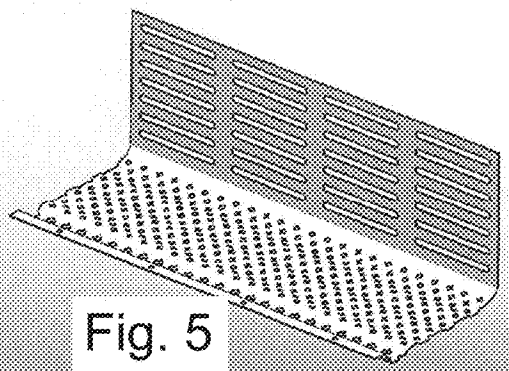
FIG. 5 depicts a portion of a drop in gutter cover for protecting a gutter in accordance with an alternative embodiment of the present disclosure.

Referring to FIG. 5, a portion of a drop in gutter cover for protecting a gutter in accordance with an alternative embodiment of the present disclosure. As shown in FIG. 5, the drop in gutter cover may further include a fascia plate that is formed with the drop in gutter cover. It is noted herein that the various embodiments, dimensions, features and architecture described previously herein should be interpreted to extend to the apparatus of FIG. 5.

Figure 6:
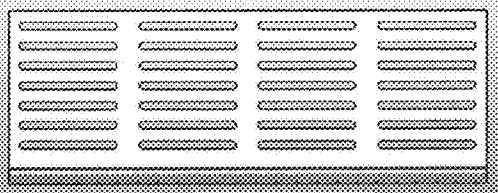
FIG. 6 depicts an exploded view of a fascia plate of the drop in gutter cover in accordance with an embodiment of the present disclosure.

FIG. 6 depicts an exploded view of a fascia plate of the drop in gutter cover in accordance with an embodiment of the present disclosure. The fascia plate may protect a fascia gap between the roof of a structure and the gutter. The fascia plate may include pre-made slots to allow ventilation and improve installation by providing cutouts to allow quick adjustment in the vertical height of the fascia plate while being installed.

For example, fascia plate may include pre-made slots which may run along a length of the fascia plate. The pre-made slots may improve ventilation and also may enhance installation. As the vertical height of the fascia gap may vary, the vertical height of the fascia plate may be adjusted. For example, the pre-made slots may allow the fascia plate to be installed next to a roof that includes horizontal irregularities. For example, a varying number of slots may be removed when installation of the fascia plate is required adjacent to a roof that has a changing or varying level at its edge. The pre-made slots allow an installer to quickly adjust the height of the fascia plate during an installation process. In an embodiment of the disclosure, the pre-made slots may be about 6 to 8 inches long and may be about ⅜ inch wide. There may be a half inch between each of the channels. While the fascia plate may be suitable for a 3 to 4-inch fascia gap, through use of the pre-made slots, the vertical height of the fascia plate may be quickly reduced by an installer to 1 inch, 2 inches, 3 inches and the like in an efficient manner during installation.

Figure 7:
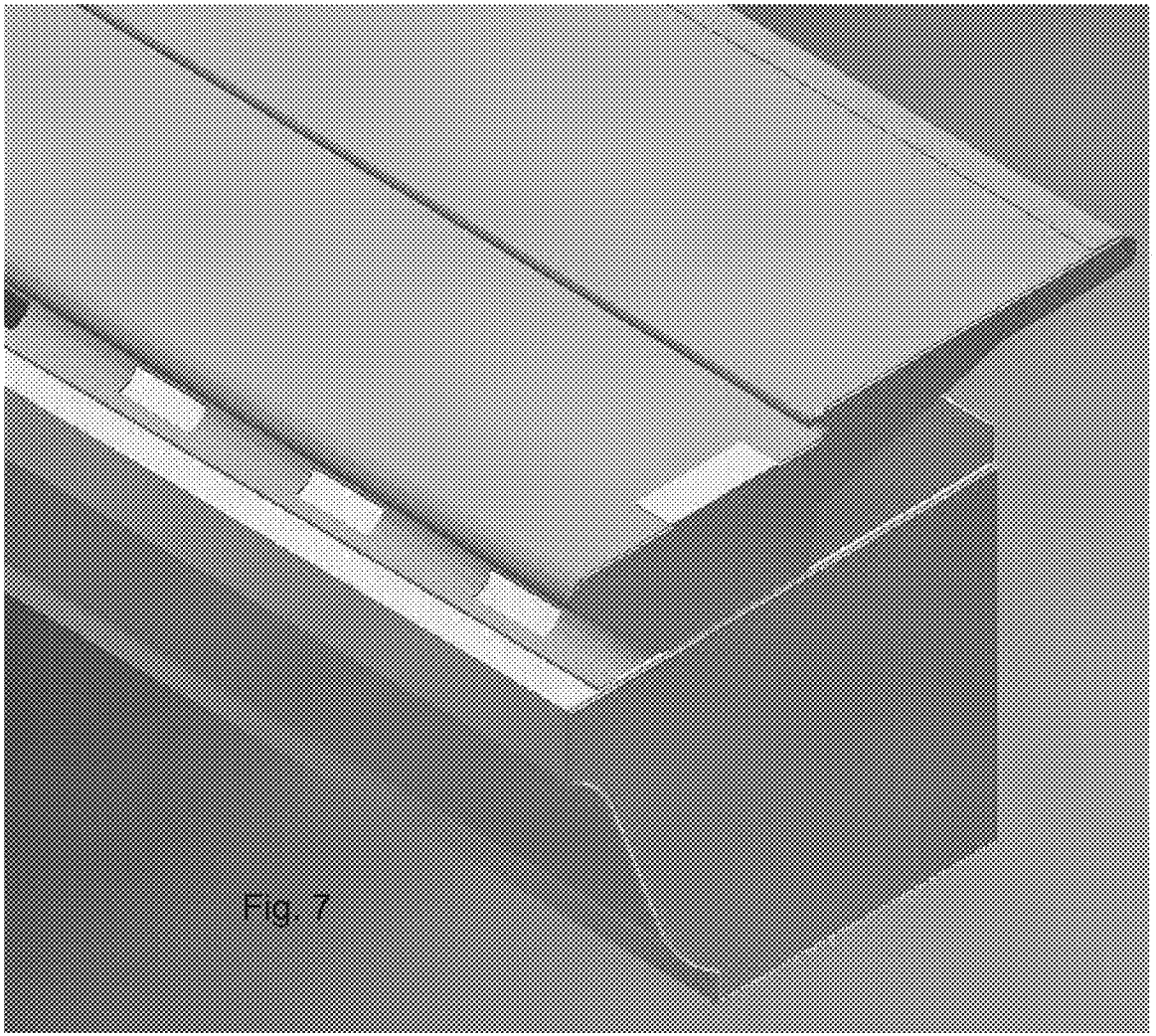
FIG. 7 depicts a gutter cover assembly for protecting a gutter in accordance with another embodiment of the present disclosure.

Referring to FIG. 7, a gutter cover assembly for protecting a gutter in accordance with another embodiment of the present disclosure is shown. As shown in FIG. 7, the gutter cover assembly may be a surface tension product and may include a plurality of apertures placed within a water channel. It is contemplated that the gutter cover assembly functioning as a surface tension product may reverse the flow of water and direct the flow of water into the water channel of the gutter cover. However, in another embodiment of the disclosure, it is contemplated that diamond-shaped apertures may be placed along the water channel. For example, there may be approximately six rows of diamond-shaped apertures starting from a top of the water channel and extending into the location where the cover panel is fastened into a gutter lip. It is contemplated that there may be two to eight rows of diamond-shaped apertures located in the water channel. These diamond-shaped apertures may be off-set and overlap. It is further contemplated that roof shingle granule(s) may pass through the diamond-shaped apertures as water churns in the water channel.

It is contemplated that the gutter cover assembly and corner diverter of FIGS. 7-11 may be formed of various rigid, lightweight material such as metal, plastic and composites without departing from the scope and intent of the present disclosure. For example, the gutter cover assembly and corner diverter may be formed from aluminum, polyvinyl chloride, or fiberglass. In another embodiment, the gutter cover assembly and corner diverter are formed from a sheet of steel coated in an alloy. For example, the gutter cover assembly and corner diverter may be formed from steel that is hot-dip coated in a zinc-aluminum-magnesium alloy.

Figure 8:
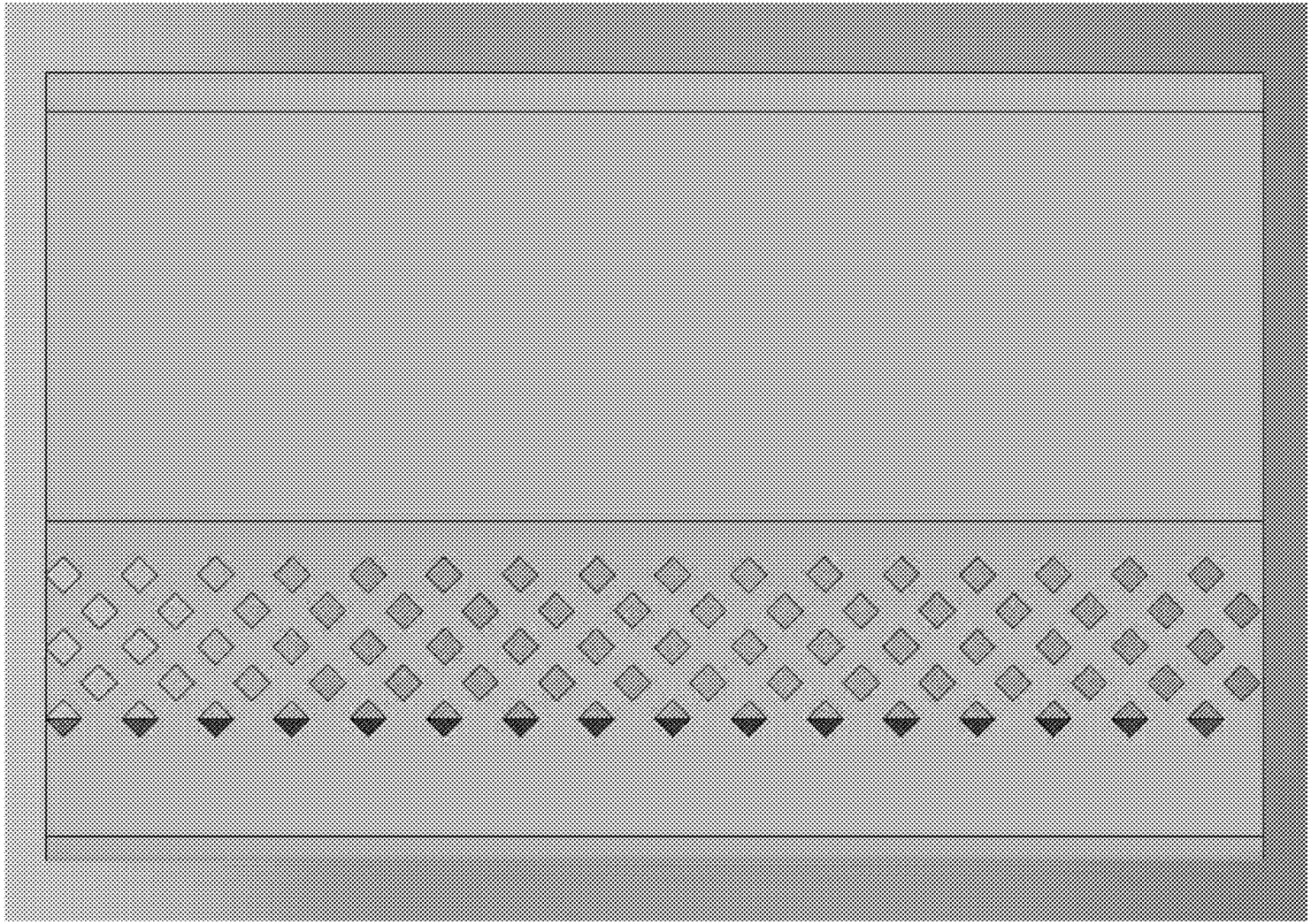
FIG. 8 depicts a perspective view of a gutter cover assembly for protecting a gutter in accordance with an embodiment of the present disclosure.

Referring to FIG. 8, a gutter cover assembly for covering a gutter in accordance with an embodiment of the present disclosure is shown. In one embodiment, the gutter cover assembly includes an upper portion that is flat and secured to a roof under the shingles. In another embodiment, the gutter cover assembly includes an upper portion that is bent and attached directly to the fascia of a roof. For example, the gutter cover assembly may be secured under the first row of shingles. In one embodiment, the upper portion of the gutter cover assembly includes apertures.

In one embodiment, there are in a range 4 to 8 rows of apertures in the upper portion of the gutter cover assembly along a direction orthogonal to the direction of the edge of the roof. For example there, may be 5 rows of apertures in the gutter cover assembly along a direction orthogonal to the direction of the edge of the roof. In another embodiment, a centroid location of the apertures on the upper portion of the gutter cover assembly are spaced in a range of ⅜ to ⅝ inch. For example, the centroid location of the apertures on the upper portion of the gutter cover assembly may be spaced ½ inch along a direction parallel to the edge of the roof.

In one embodiment, the size of the apertures on the upper portion of the gutter cover assembly is in a range of ⅛ to ¼ inch wide. For example, the size of the apertures on the upper portion of the gutter cover assembly may be 3/16 inch wide. In another embodiment, the apertures on the upper portion of the gutter cover assembly size are diamond-shaped. In another embodiment, at least one side of the diamond-shaped apertures on the upper portion of the gutter cover assembly form an oblique angle with the edge of the roof. In another embodiment, the oblique angle formed by at least one side of the diamond-shaped apertures on the upper portion of the gutter cover assembly with the edge of the roof is the same angle. It is contemplated that the size of the apertures on the upper portion of the gutter cover assembly will allow roof shingle granule(s) to pass through the apertures.

In one embodiment, the diamond-shaped apertures located in the water channel of the gutter cover assembly may be sized in the same range and dimensions, and with the same centroid location spacing as the apertures in the upper portion of the gutter cover assembly. It is contemplated that the apertures in the lower portion of the gutter cover assembly are arranged in a way where water droplets traveling a straight line may cross at least one of the apertures. While the apertures are shown as diamond-shaped, they may be circular, triangular, square and various other shaped. It is contemplated that the apertures may prevent debris from entering the gutter. It is further contemplated that the apertures may prevent leaves (e.g. deciduous leaves, coniferous needles), fruits (e.g. nuts, berries, and samaras) and seeds from entering the gutter.

Figure 9:
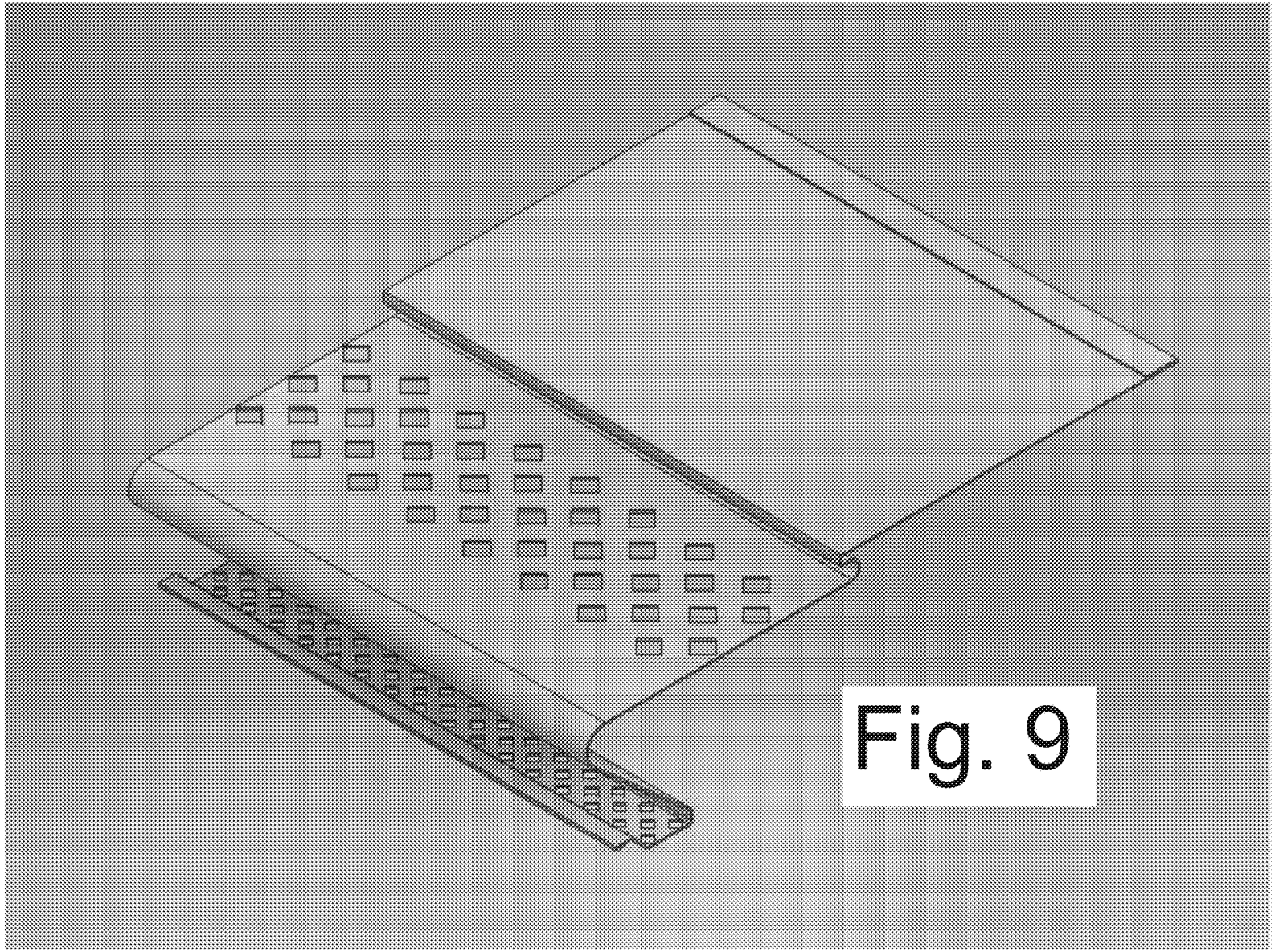
FIG. 9 depicts a perspective view of a gutter cover assembly for protecting a gutter in accordance with an embodiment of the present disclosure.

Referring to FIG. 9, a perspective view of a gutter cover assembly for protecting a gutter in accordance with an embodiment of the present disclosure. In one embodiment, the diamond-shaped apertures located in the water channel of the gutter cover assembly may be sized in the same range and dimensions, and with the same centroid location spacing as the apertures of the first size in the first portion of the drop in gutter cover. In one embodiment, a centroid location of the apertures in the water channel of the gutter cover assembly are spaced in a range of ⅜ to ⅝ inch. For example, the centroid location of the apertures in the water channel of the gutter cover assembly may be spaced ½ inch along the length of the gutter cover assembly that runs in a direction parallel to the fascia of the roof.

In one embodiment, the size of the apertures in the water channel of the gutter cover assembly is in a range of 1/16 to 3/16 inch wide. For example, the size of the apertures in the water channel of the gutter over assembly may be ⅛ inch wide. In another embodiment, the apertures in the water channel of the gutter cover assembly are diamond-shaped. It is contemplated that the oblique angle formed by at least one side of the diamond-shaped apertures of the apertures of the first size with the fascia of the roof may be the same angle.

Figure 10:
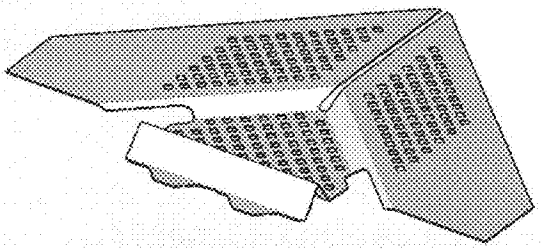
FIG. 10 depicts a perspective view of a corner diverter section in accordance with an embodiment of the present disclosure.
Figure 11:
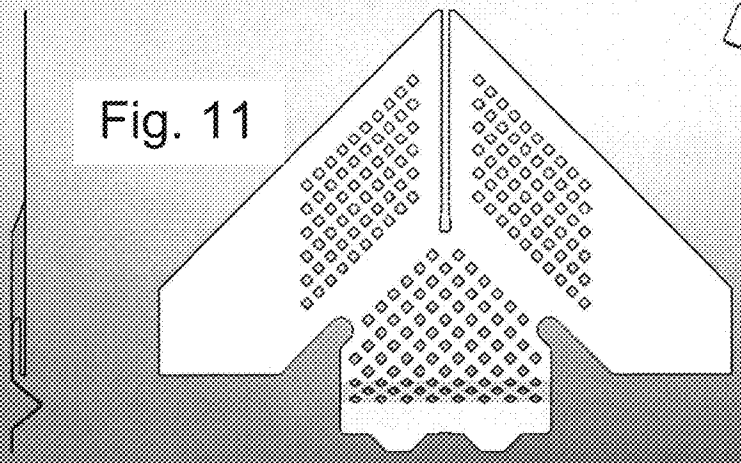
FIG. 11 depicts a top view of a corner diverter section in accordance with an embodiment of the present disclosure.

Referring to FIG. 10, a perspective view of a corner diverter section in accordance with an embodiment of the present disclosure is shown. In one embodiment, the corner diverter section includes apertures. In one embodiment, the size of the apertures of the corner diverter section is in a range of ⅛ to ¼ inch wide. For example, the size of the apertures of the corner diverter section may be 3/16 inch wide. In another embodiment, a centroid location of the apertures of the corner diverter section are spaced in a range of 5/16 to 7/16 inch.

In one embodiment, there is a first centroid location spacing of the apertures of the corner diverter section and a second centroid location spacing of the apertures of the corner diverter section. For example, the first centroid location spacing of the apertures of the corner diverter section may be in the range of 5/16 to 6/16 inch and a second centroid location spacing of the apertures of the corner diverter section may be in the range of 6/16 to 7/16 inch. In another embodiment, the centroid location spacing of apertures on an upper portion of the corner diverter section is different from the centroid location spacing of apertures on a lower portion of the corner diverter section. In another embodiment, the centroid location spacing of apertures on the upper portion of the corner diverter section is smaller than the centroid location spacing of the apertures on the lower portion of the corner diverter section. While the apertures of the corner diverter section are shown as diamond-shaped, they may be circular, triangular, square and various other shaped. In one embodiment, diamond-shaped apertures of the corner diverter section are arranged such that at least one edge of the diamond-shaped apertures are either orthogonal or parallel to the direction of the edge of the roof.

In one embodiment, there are in a range of 5 to 7 rows of apertures in the upper portion of the corner diverter section along a direction orthogonal to the direction of the edge of the roof. For example, there may be 6 rows of apertures in the upper portion of the corner diverter section along a direction orthogonal to the edge of the roof. In one embodiment, there are 6 to 11 rows of apertures in the lower portion of the corner diverter section along a direction orthogonal to the direction of the edge of the roof. It is contemplated that the number of rows of apertures that extend from the side of the corner diverter section closest to the roof in an orthogonal direction to the edge of the roof will vary based on the shape of the corner diverter section at a particular row location.

In another embodiment, the corner diverter section includes an angled ridge disposed near the front lip of the gutter to prevent water from flowing off the corner diverter section and thereby avoiding capture by the gutter. In another embodiment, the angled ridge of the corner diverter section includes apertures on one surface of the angled ridge and no apertures on another surface of the angled ridge. For example, the angled ridge may be formed from two surfaces joined at a location to form the ridge where one surface of the ridge faces the roof and includes apertures while another surface of the ridge facing away from the house and has no apertures.

In one embodiment, the corner diverter section attaches to the front lip of the gutter. In another embodiment, the corner diverter section is installed under the first row of shingles. In another embodiment, the upper portion of the corner diverter section is disposed next to the upper portion of the gutter cover assembly. It is contemplated that the apertures on the upper portion of the corner diverter section will be disposed next to the upper portion of the gutter cover assembly. It is further contemplated that there is a declining surface that connects the upper portion of the corner diverter section and the lower portion of the corner diverter section.

FIG. 10 depicts a top view of a corner diverter section in accordance with an embodiment of the present disclosure. A corner diverter may be employed in corners of two gutters. Conventional devices are formed of multiple pieces. The corner diverter of the present disclosure may be a single integrated piece and may further include a ridge to prevent water flow across and then off the corner diverter. In one embodiment, the upper portion of the corner diverter section includes a gap that divides the upper portion into two side portions. It is contemplated that the gap in the upper portion of the corner diverter section will have a number of benefits relating to installation. For example, the gap allows the two side portions of the upper portion of the corner diverter section to flex independently of each other. By way of another example, the gap allows the corner diverter section to be installed with a greater number of roofing and/or shingle configurations and components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A cover for protecting a gutter, comprising:

a first portion, the first portion including apertures of a first size aligned to capture water flowing from a roof of a structure, wherein the apertures of the first size are punched through a solid piece of material and include a width in a range of 1/16 to 3/16 inch, wherein the first portion extends in a range of 3 to 4 inches and includes 11 to 15 rows of apertures of the first size which are spaced in a range of 3/8 inch to 5/8 inch, the first portion having a corrugated surface;

a second portion, the second portion including a channel and apertures of a second size, the apertures of the second size are punched through the solid piece of material, wherein the channel includes two vertical walls joined by a horizontal bottom surface, a first vertical wall of the channel is proximate to the first portion and a second vertical wall is proximate to an end edge of the second portion, wherein the channel is configured to direct water to pool and flow in a circular motion before draining through the apertures of the second size, wherein the apertures of the second size are larger than the apertures of the first size and include a width in a range of 1/8 to 1/4 inch, wherein the second portion extends in a range of 3/4 to 1.5 inch from the first portion and includes 1 to 4 rows of apertures of the second size which are spaced in a range of 3/8 inch to 5/8 inch, the channel having a depth of 3/16 inch to 7/16 inch;

wherein an end of the first portion is configured to be mounted to a fascia of the roof and the end edge of the second portion is configured to be mounted on top of a front lip of the gutter such that a bottom of the channel is below a top of the front lip of the gutter.

2. The cover as claimed in claim 1, wherein the cover is is at an angle of 15 to 20 degrees, and the cover is formed from at least one of an aluminum, a polyvinyl chloride, a fiberglass, or a sheet of steel that is hot-dip coated in a zinc-aluminum-magnesium alloy.

3. The cover as claimed in claim 1, wherein the apertures of the first size and the apertures of the second size include a diamond-shaped opening, and the apertures of the first size include a width of 1/8 inch and the apertures of the second size include a width of 3/8 inch.

4. The cover as claimed in claim 3, wherein the diamond-shaped opening of the apertures of the first size and the apertures of the second size are aligned such that a side of each diamond-shaped opening forms a same oblique angle with the fascia of the roof and the centroid location of the apertures of the first size is spaced 1/2 inch along a direction parallel to the fascia of the roof and the centroid location of the apertures of the second size is spaced 1/2 inch along a direction parallel to the fascia of the roof.

5. The cover as claimed in claim 1, wherein the first portion having a corrugated surface has at least two ridges.

6. The cover as claimed in claim 5, wherein the apertures of the first size are placed co-linearly with lines of the at least two ridges.

7. The cover as claimed in claim 1, further comprising:

a fascia plate extending from the end of the first portion of the cover.

8. The cover as claimed in claim 7, wherein the fascia plate is formed of a solid piece of material and includes a plurality of pre-made slots punched through the solid piece of material.

9. The cover as claimed in claim 8, wherein the plurality of pre-made slots run along a length of the fascia plate.

10. The cover as claimed in claim 8, wherein each pre-made slot is six to eight inches long.

11. The cover as claimed in claim 10, wherein each pre-made slot is ⅜ inch wide.

12. The cover as claimed in claim 8, wherein the fascia plate has a depth of three to four inches, and rows of the plurality of pre-made slots have a half inch between each row.

13. The cover as claimed in claim 8, wherein the fascia plate is bendable along a row of pre-made slots.

* * * * *